US005613934A

United States Patent [19]

May

[11] Patent Number: 5,613,934

[45] Date of Patent: Mar. 25, 1997

[54] METHOD OF FORMING A TEAR GUIDE ARRANGEMENT

[75] Inventor: Timothy J. May, Greenville, Wis.

[73] Assignee: Reynolds Consumer Products Inc., Appleton, Wis.

[21] Appl. No.: 627,539

[22] Filed: Apr. 4, 1996

Related U.S. Application Data

[62] Division of Ser. No. 501,221, Jul. 11, 1995, Pat. No. 5,552,202.

[51] Int. Cl.[6] ..... B31B 1/90

[52] U.S. Cl. ..... 493/214; 493/212; 493/213

[58] Field of Search ..... 493/193–197, 493/210, 211, 212, 213, 214, 215, 923, 927, 930, 962

[56] References Cited

U.S. PATENT DOCUMENTS

| | | | |
|---|---|---|---|
| 3,780,781 | 12/1973 | Uramoto | 383/204 |
| 3,827,472 | 8/1974 | Uramoto | 150/3 |
| 4,700,531 | 10/1987 | Hsu | 493/212 |
| 4,720,011 | 1/1988 | Canamero | 206/455 |
| 4,744,674 | 5/1988 | Nocek | 383/63 |
| 4,846,585 | 7/1989 | Boeckmann | 383/5 |
| 4,986,673 | 1/1991 | Bell | 383/61 |
| 5,093,187 | 3/1992 | Engelmann | 428/212 |
| 5,470,156 | 11/1995 | May | 493/213 |
| 5,558,613 | 6/1996 | Tilman | 493/212 |
| 5,575,747 | 11/1996 | Dais | 493/213 |

*Primary Examiner*—Scott A. Smith
*Assistant Examiner*—Christopher W. Day
*Attorney, Agent, or Firm*—Alan T. McDonald

[57] ABSTRACT

A tear guide arrangement for opening a package from a sealed form, the package having first and second opposing films, comprises first and second opposing base strips, first and second opposing tear guide strips, and sealant material. The first and second base strips are disposed between the first and second films and are adapted for attachment to the respective first and second films. The first base strip has upper and lower sides and the second base strip has upper and lower sides. The first and second base strips are composed of a first polymeric material. The first and second tear guide strips are disposed generally parallel to and co-planar with the respective first and second base strips. The first and second tear guide strips are detachably connected to the upper sides of the respective first and second base strips to form respective breakable bonds. The first and second tear guide strips are composed of a second polymeric material which is stiffer than the first polymeric material. The sealant material is disposed between the first tear guide strip and the first film for firmly attaching the first tear guide strip to the first film. The sealant material is also disposed between the second tear guide strip and the second film for firmly attaching the second tear guide strip to the second film.

5 Claims, 2 Drawing Sheets

METHOD OF FORMING A TEAR GUIDE ARRANGEMENT

This application is a division of Ser. No. 08/501,221 filed Jul. 11, 1995 now U.S. Pat. No. 5,552,202.

FIELD OF THE INVENTION

The present invention generally relates to opening arrangements for polymeric (plastic) packages and, more particularly, relates to a tear guide arrangement for opening a package from a sealed condition.

BACKGROUND OF THE INVENTION

In many consumer packaging applications, it is important to prevent air or water or the like from passing out of or into a package containing certain food products. This is particularly true with respect to cheese packages, meat packages, and the like, for which the contained product must be kept in a constant environment to prevent spoilage. In order to preserve the product contained within such a package, the periphery of the package must be hermetically sealed.

It is also desirable to provide a convenient and effective way to reseal the package after it has been opened. In this respect, recloseable zipper seals are advantageous. On the other hand, recloseable seals alone provide an opportunity for undesired tampering with the contents of a package. To reduce the opportunity for undetected tampering, packages with recloseable zippers can be permanently sealed above or below the recloseable zipper in such in manner that the opening of the package becomes apparent.

However, seals which inhibit tampering may be difficult for the consumer to open. Such seals may require the consumer to break the seals by cutting them with a scissors or knife. To overcome this problem, a tear bead or guide can be combined with a recloseable zipper to provide a package which is easy for the consumer to open and reseal and yet minimizes the opportunities for undetected pre-sale product tampering.

Existing tear guides are often inadequate because they expose the food products within the package to air outside the package, thereby defeating the purpose of the hermetic seals around the periphery of the package. Such exposure to air can degrade the quality of the food products within the package. Furthermore, existing tear guides often fail to cleanly open the package because the tear guide will deviate from a straight path across the mouth end of the package. In some cases, the tear guide will wander off the package prior to traversing the entire mouth end thereof such that the tear guide fails to fully open the package.

A need therefore exists for a tear guide arrangement for a polymeric package which overcomes the aforementioned shortcomings associated with existing tear guides.

SUMMARY OF THE INVENTION

A tear guide arrangement for opening a package from a sealed form, the package having first and second opposing films, comprises first and second opposing base strips, first and second opposing tear guide strips, and sealant material. The first and second base strips are disposed between the first and second films and are adapted for attachment to the respective first and second films. The first base strip has upper and lower sides and the second base strip has upper and lower sides. The first and second base strips are composed of a first polymeric material. The first and second tear guide strips are disposed generally parallel to and co-planar with the respective first and second base strips. The first and second tear guide strips are detachably connected to the upper sides of the respective first and second base strips to form respective breakable bonds. The first and second tear guide strips are composed of a second polymeric material which is stiffer than the first polymeric material. The sealant material is disposed between the first tear guide strip and the first film for firmly attaching the first tear guide strip to the first film. The sealant material is also disposed between the second tear guide strip and the second film for firmly attaching the second tear guide strip to the second film.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
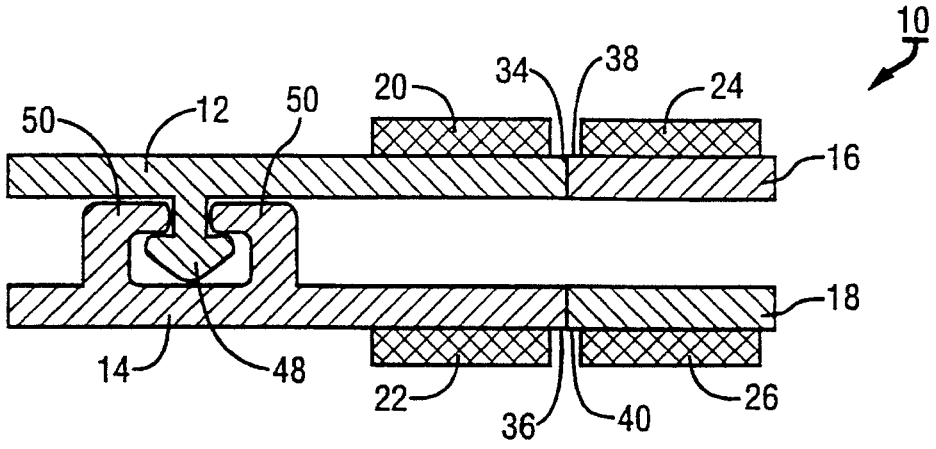
FIG. 1 is an enlarged cross-sectional view of a tear guide arrangement embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Figure 2:
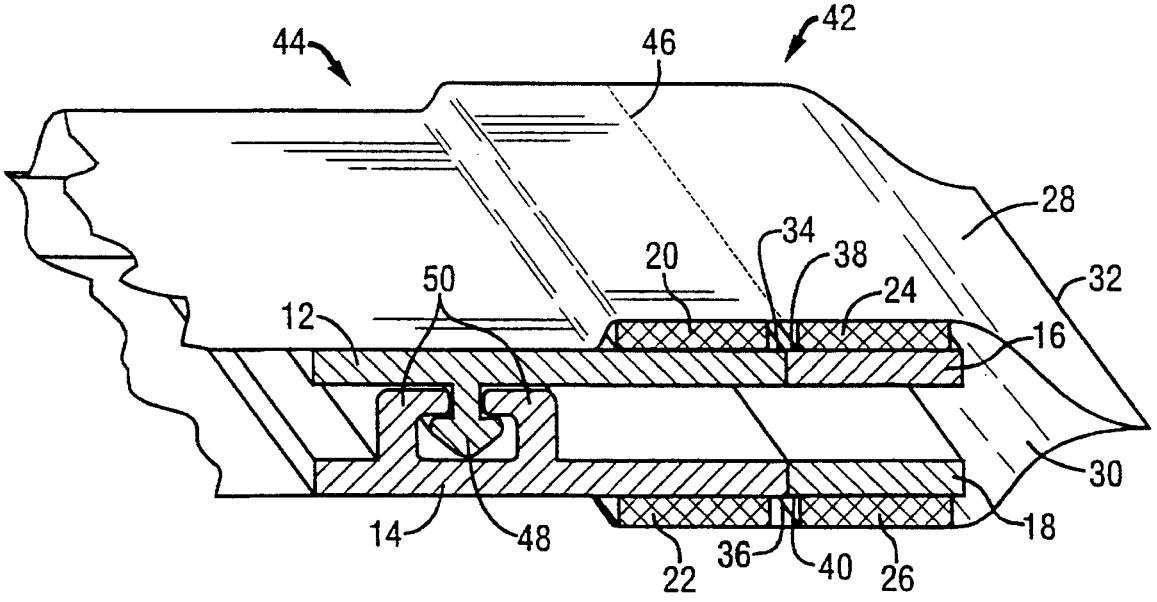
FIG. 2 is a fragmental perspective view of a package incorporating the tear guide arrangement in FIG. 1, prior to opening the package.
Figure 3:
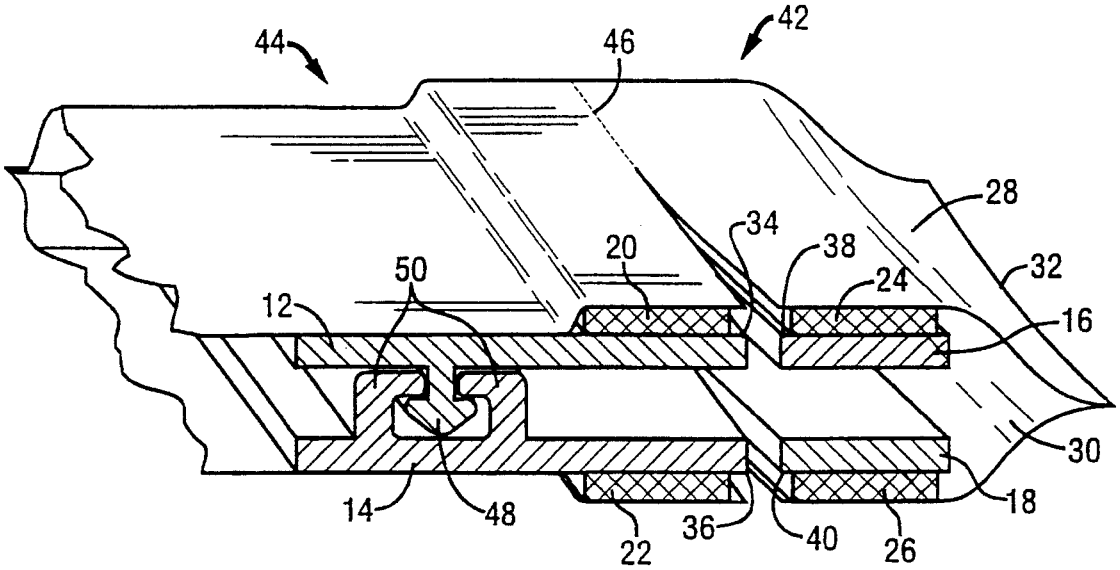
FIG. 3 is a fragmental perspective view of the package in FIG. 2 in the process of being opened.
Figure 4:
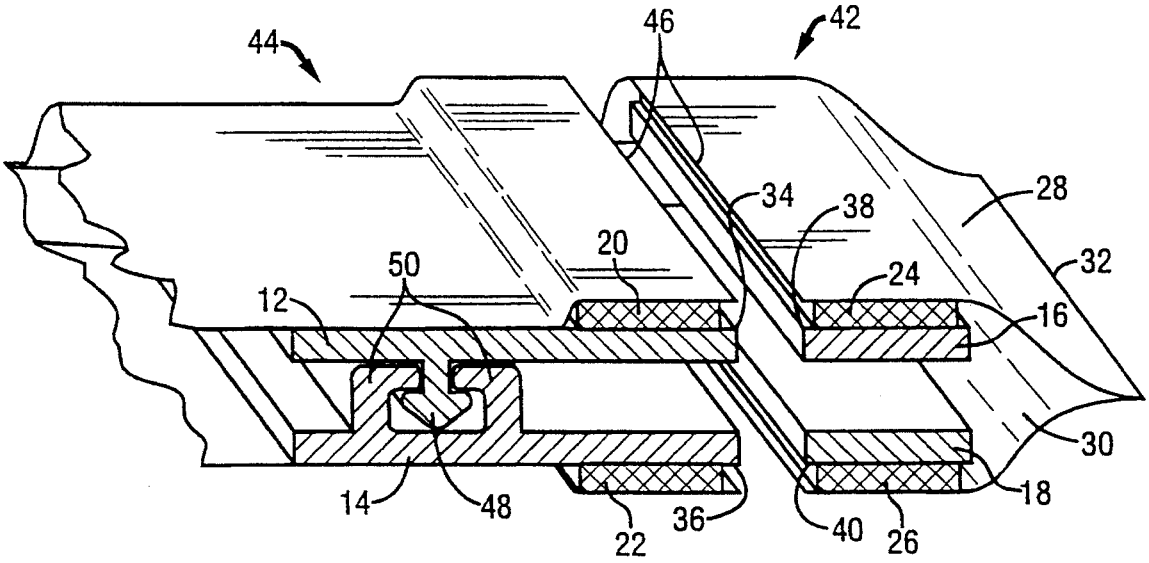
FIG. 4 is a fragmental perspective view of the package in FIG. 2 after being opened.

Turning now to the drawings, FIG. 1 illustrates a tear guide arrangement 10 prior to being thermally fused between opposing films of a package. The tear guide arrangement 10 generally includes a pair of opposing base strips 12 and 14, a of opposing tear guide strips 16 and 18, and a plurality of sealant strips 20, 22, 24, and 26. As depicted in FIGS. 2–4, the tear guide arrangement 10 is thermally fused between opposing films 28 and 30 of a package which is hermetically sealed along its periphery. The tear guide arrangement 10 extends along the length of the mouth end of the package beneath the sealed top edges 32 of the films 28 and 30, and is used to open the package from its hermetically sealed form. For the sake of simplicity, FIGS. 2–4 only depict the mouth end of the package.

The base strips 12 and 14 are substantially composed of a resilient polymeric material such as low density polyethylene. Referring to FIGS. 2–4, the base strips 12 and 14 are generally parallel to each other and are positioned between the opposing films 28 and 30 of the package. The sealant strips 20 and 22 are used to indirectly attach the base strips 12 and 14 to the respective films 28 and 30. The sealant strip 20 firmly attaches the base strip 12 to the inner surface of the film 28, while the sealant strip 22 firmly attaches the base strip 14 to the inner surface of the film 30. Each bond provided by the sealant strips 20 and 22 has a strength ranging between about 7 pounds per lineal inch and about 10 pounds per lineal inch as measured along the length of the bond. The sealant strips 20 and 22 are substantially composed of a sealant polymeric material, such as ethylene vinyl acetate, which bonds readily to other polymeric materials at low temperatures. Alternatively, the base strips 12 and 14 may be thermally fused directly to the respective films 28 and 30 by use of higher temperatures, greater pressure, and/or greater dwell time of a conventional heat seal bar during the thermal fusion process.

The base strips 12 and 14 are generally rectangular in cross-sectional shape. In particular, the base strip 12 has opposing inner and outer surfaces and opposing upper and lower sides bridging the inner and outer surfaces. The outer corner 34 formed at the junction of the outer surface and the upper side of the base strip 12 is sharp. Similarly, the base strip 14 has opposing inner and outer surfaces and opposing upper and lower sides bridging the inner and outer surfaces. Like the outer corner 34, the outer corner 36 formed at the junction of the outer surface and the upper side of the base strip 14 is sharp. As explained below, the sharp corners 34 and 36 provided by the respective base strips 12 and 14 cooperate with sharp outer corners provided by the respective tear guide strips 16 and 18 to evenly tear the films 28 and 30 while opening the package.

The pair of tear guide strips 16 and 18 are substantially composed of a stiff or tough polymeric material such as polypropylene having a substantially higher tensile strength than the resilient material of the base strips 12 and 14. The tear guide strips 16 and 18 are disposed generally parallel to and co-planar with the respective base strips 12 and 14. Moreover, the tear guide strips 16 and 18 are generally parallel to each other and are positioned between the opposing films 28 and 30 of the package. Although it is not necessary, the tear guide strips 16 and 18 may be thermally fused to each other. The sealant strips 24 and 26 attach the tear guide strips 16 and 18 to the respective films 28 and 30. Like the sealant strips 20 and 22, the sealant strips 24 and 26 are substantially composed of a sealant polymeric material, such as ethylene vinyl acetate, which bonds readily to other polymeric materials at low temperatures. The sealant strips 24 and 26 ensure strong unbreakable bonds between the tear guide strips 16 and 18 and the respective films 28 and 30. In the preferred embodiment, each unbreakable bond has a strength ranging between about 7 pounds per lineal inch and about 10 pounds per lineal inch as measured along the length of the bond.

Like the base strips 12 and 14, the tear guide strips 16 and 18 are generally rectangular is cross-sectional shape. The stiff polymeric material of the tear guide strips 16 and 18 enables each of the tear guide strips to be provided with straight inner and outer surfaces and straight upper and lower sides bridging the inner and outer surfaces. These straight surfaces and sides, in turn, define four sharp corners. The tear guide strip 16 includes the sharp outer corner 38 formed at the junction of its outer surface and its lower side. Similarly, the tear guide strip 18 includes the sharp outer corner 40 formed at the junction of its outer surface and its lower side.

When the tear guide arrangement 10 is intact (FIG. 2), the lower sides of the tear guide strips 16 and 18 are detachably connected to the upper sides of the respective base strips 12 and 14. With the tear guide strips 16 and 18 connected to the respective base strips 12 and 14, the sharp outer corner 38 of the tear guide strip 16 is immediately adjacent to the sharp outer corner 34 of the base strip 12, and the sharp outer corner 40 of the tear guide strip 18 is immediately adjacent to the sharp outer corner 36 of the base strip 14.

The tough polymeric material of the tear guide strips 16 and 18 is substantially stiffer than the resilient polymeric material of the base strips 12 and 14 so that the bonds between the tear guide strips 16 and 18 and the respective base strips 12 and 14 are inherently weak and easily broken. In the preferred embodiment, these breakable bonds each have a strength ranging between about 0.25 pounds per lineal inch and about 0.50 pounds per lineal inch as measured along the length of the breakable bonds. It is preferred to substantially compose the tear guide strips 16 and 18 from polypropylene and the base strips 12 and 14 from low density polyethylene because these two materials have an inherent nonaffinity for each other.

To break the bonds between the tear guide strips 16 and 18 and the respective base strips 12 and 14, a user grasps and pulls an upper portion 42 of the package in a direction generally opposite to a lower portion 44 of the package. With respect to the illustrated package in FIG. 2, the direction of the opening force applied to the upper portion 42 is generally horizontal and to the right. To facilitate commencement of the breaking of the bonds, the opposing films 28 and 30 of the package preferably form a minute notch (not shown) along one (or both) of the opposing side edges of the package at a location adjacent to one end of the breakable bonds.

As depicted in FIG. 3, detaching the tear guide strips 16 and 18 from the respective base strips 12 and 14 ruptures the films 28 and 30 along tear lines 46 so as to open the package from a hermetically sealed form. The minute notch formed in the side edge of the package assists in initiating this rupture of the films 28 and 30. The stiff polymeric material of the tear guide strips 16 and 18 ensures that the tear guide strips 16 and 18 separate cleanly from the respective base strips 12 and 14, and this stiff material provides the mass essential to an effective, reliable, and high quality bond rupture. The adjacent sharp corners 34 and 38 and the adjacent sharp corners 36 and 40 assist in tearing the opposing films 28 and 30 so that the tear lines 46 are even. The sealant strips 20 and 22 ensure that the base strips 12 and 14 adhere to the respective films 28 and 30 substantially up to the location of the tear lines 46. After the tear guide strips 16 and 18 have been detached from the respective base strips 12 and 14, the package appears as illustrated in FIG. 4.

The tear guide arrangement 10 is optionally provided with a conventional recloseable zipper to permit repeated opening and closing of the package after it is initially torn open. More specifically, a male locking member 48 is integrally formed with and extends inwardly from the base strip 12 toward the base strip 14. A pair of female locking members 50 are integrally formed with and extend inwardly from the base strip 14 toward the base strip 12. These female locking members 50 form a groove therebetween for receiving the locking member 48. The male and female locking members 48 and 50 are preferably composed of the same resilient material, e.g., low density polyethylene, used to form the base strips 12 and 14.

After initially tearing open the package, the zipper is closed as depicted in FIG. 4. The male and female locking members 48 and 50 are interlocked to each other. To open the package and gain access to the contents thereof, the interlocked male and female members 48 and 50 are disengaged from each other by grabbing onto the opposing films 28 and 30 near the top edges thereof and pulling them apart. To reclose the package with the zipper, the female locking members 50 are interlocked with the male locking member 48 in a snapping action caused by bringing hooks formed by the female locking members 50 beyond an expanded head formed by the male locking member 48. The engagement of the expanded head of the male locking member 48 with the hooks of the female locking members 50 maintains the male locking member 48 in the groove formed between the female locking members 50.

The tear guide arrangement 10 in FIG. 1 is manufactured using conventional extrusion techniques. The base strips 12 and 14, the tear guide strips 16 and 18, the sealant strips 20, 22, 24, and 26, and the locking members 48 and 50 are coextruded through a die fed by a plurality of extruders containing the various polymeric materials forming the aforementioned elements of the tear guide arrangement 10. The die configures the melted polymeric materials fed thereto by the extruders into the shapes depicted in FIG. 1. The melted polymeric materials exit the die with the illustrated attachments. Since the exiting polymeric materials form a continuous tear guide arrangement, the continuous tear guide arrangement is conveyed to a cutter which divides the continuous arrangement into the individual tear guide arrangements 10.

After forming the tear guide arrangement 10 as described above, the tear guide arrangement 10 is thermally fused between the opposing films 28 and 30 of a package at the mouth end thereof (FIG. 2). The film 28 is directly fused to the sealant strips 20 and 24, while the film 30 is directly fused to the sealant strips 22 and 26. During this thermal fusing process, the tear guide strips 16 and 18 are optionally fused to each other. Prior to hermetically sealing the entire periphery of the package, a food product is loaded into the package using conventional means. This food product, for example, may be loaded into the package via an open bottom end, which is subsequently sealed.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention, which is set forth in the following claims.

What is claimed is:

1. A method of forming a tear guide arrangement to be secured between first and second opposing films of a package, said method comprising the steps of:

forming first and second opposing base strips adapted to be disposed between the first and second films and adapted for attachment to the respective first and second films, said first base strip having upper and lower sides and said second base strip having upper and lower side, said first and second base strips being composed of a first polymeric material;

forming first and second opposing tear guide strips disposed generally parallel to and generally co-planar with said respective first and second base strips, said first and second tear guide strips being detachably connected to said upper sides of said respective first and second base strips to form respective breakable bonds, said first and second tear guide strips being composed of a second polymeric material which is stiffer than said first polymeric material; and forming first and second sealant strips along outer surfaces of said respective first and second tear guide strips, said first and second sealant strips being adapted to firmly attach said first and second tear guide strips to the respective first and second films.

2. The method of claim 1, wherein said second polymeric material is substantially composed of polypropylene.

3. The method of claim 2, wherein said first polymeric material is substantially composed of low polypropylene.

4. The method of claim 3, wherein said first and second sealant strips are substantially composed of ethylene vinyl acetate.

5. The method of claim 1, wherein said step of forming said base strips, said step of forming said tear guide strips, and said step of forming said sealant strips are performed simultaneously by coextruding said base strips, said tear guide strips, and said sealant strips.

* * * * *